US005603317A

United States Patent [19]

Farmer

[11] Patent Number: 5,603,317

[45] Date of Patent: Feb. 18, 1997

[54] ENVIRONMENTAL MASK

[76] Inventor: Charlene C. Farmer, 4947 N. Flamingo Ave., Odessa, Tex. 79764-9381

[21] Appl. No.: 621,525

[22] Filed: Mar. 25, 1996

[51] Int. Cl.[6] ..... A62B 7/10

[52] U.S. Cl. ..... 128/205.27; 128/206.12; 128/206.28; 128/206.29

[58] Field of Search ..... 128/205.27, 206.12, 128/206.17, 206.21, 206.28, 206.29

[56] References Cited

U.S. PATENT DOCUMENTS

| | | | |
|---|---|---|---|
| 535,718 | 3/1895 | Nagler | 128/206.12 |
| 770,013 | 9/1904 | Linn | 128/206.29 |
| 838,434 | 12/1906 | Morgan | 128/206.29 |
| 893,213 | 7/1908 | Whiteway | 128/206.16 |
| 925,409 | 6/1909 | Woolf et al. | 128/206.16 |
| 1,079,227 | 11/1913 | Fanning | 128/206.16 |
| 1,362,766 | 12/1920 | McGargill | 128/206.29 |
| 2,521,084 | 9/1950 | Oberto | 128/206.29 |
| 2,708,932 | 5/1955 | Pipher | 128/206.16 |
| 3,049,121 | 8/1962 | Brumfield et al. | 128/206.14 |
| 3,346,875 | 10/1967 | Weisberger | 2/9 |
| 3,695,265 | 10/1972 | Brevik | 128/206.14 |
| 4,326,416 | 4/1982 | Fredberg | 128/720 |
| 4,719,911 | 1/1988 | Carrico | 128/206.29 |
| 4,853,974 | 8/1989 | Olim | 2/9 |
| 4,895,143 | 1/1990 | Fisher | 128/206.28 |
| 4,907,581 | 3/1990 | King | 128/200.14 |
| 5,386,825 | 2/1995 | Bates | 128/206.29 |

*Primary Examiner*—Aaron J. Lewis
*Attorney, Agent, or Firm*—Milburn & Peterson P.C.

[57] ABSTRACT

A protective environmental mask for permitting an individual to breath through the nose and mouth while applying hairspray or perfume to the individuals hair and body and protecting from undesired particulate matter contained in the hairspray or perfume. The environmental mask includes a nose cover with a facing to provide comfort in seating against the nose and face of the user and is supported by a bracket integral with the nose cover and held in position by a mouthpiece. The mouthpiece is provided with a sanitary cover which holds a filter to prevent particulate matter from passing through the mouth to the lungs of the user. The mouth filter may be eliminated by use of a sanitary cap which blocks air passage through the mouthpiece. The nose cover provides a nasal airway for the wearer's nostrils and a filter which is secured by velcro fasteners within the nose cover. Both the nose filter, and the sanitary cover and mouth filter are disposable such that the basic environmental mask may be utilized repeatedly by different individuals while maintaining sanitary conditions.

8 Claims, 2 Drawing Sheets

ENVIRONMENTAL MASK

FIELD OF INVENTION

This invention relates to an improved environmental mask through which a person applying hairspray or the like may be protected from inhaling undesired airborne particles or vapor while at the same time maintaining both hands free to apply the hairspray and set the hair. The environmental mask has a mouthpiece and a nose cover and can be held in position in the mouth and includes a filter in the nose cover and may include a filter in the mouthpiece. In another aspect, the environmental mask provides hands free spray or treating intermittent spray and shaping the hair in various forms or hairdos.

A number of devices and masks have been taught for preventing breathing in undesired fumes such as might be put off from hairspray. Many devices have been conceived to permit the application of hairspray and to protect the face and nose and mouth from the spray. Such devices include a simple face shield held in one hand while you spray with the other hand. Other devices include those in which the mask is held over the nose and mouth by an adhesive tape or the like, and also, headbands have been used to hold nose and mouth shields in place. None of these are very useful in applying hairspray since in many hair styles it requires one hand to shape the hair while the other one is used to spray the hairspray.

Nagler, U.S. Pat. No. 535,718, discloses a respirator that fits over the mouth and nostrils which includes a narrow neck between the mouthpiece and the nose guard. It may be bent and shaped to fit the individual user. There are a series of perforations in the plate A B. An impervious liner made of silk or rubber is provided. There is space provided between the liner and the plate to provide a filter material therebetween which may be replaced as needed. This mask is held in place by an elastic band.

Oberto, U. S. Pat. No. 2,521,084, discloses a mandible cushion for an oxygen mask which is designed to prevent injury to a patient and a free open air passage for breathing purposes readily adapted for attachment to an oxygen mask for administration of oxygen to a patient. It is especially useful during electric shock treatment to a patient having certain psychological conditions.

Brumfield, U.S. Pat. No. 3,049,121, discloses a disposable mask which is secured by adhesive tape to the face.

Weisberger, U.S. Pat. No. 3,346,875, discloses a nose and lip protector which may be attached to a pair of eyeglasses. The nose portion has perforations to provide for breathing. It does not illustrate the use of a filter and it is primarily designed to protect the lips and nose from sunburn, windburn or other abuse from sun and wind.

Brevik, U.S. Pat. No. 3,695,265, discloses a nose and mouth mask for removing particulate airborne matter during breathing which is secured by an adhesive patch attaches to the nose of the user. It is adapted for protection from inhaling particulate matter when hair spray or other aerosol spray is being applied. It's major drawback is the fact the user must apply and remove adhesive tape from the face.

Olim, U.S. Pat. No. 4,853,974, was provided to show the use of velcro for securing a strap at the back of the head for holding a face mask in place.

Fisher, U.S. Pat. No. 4,895,143, teaches a mouthpiece through which a person may breathe. The mouthpieces has a sealing flange for introduction into the mouth. It comprises an upper portion that lies against the hard palate and a lower portion fitting between the lower lip and the anterior surface about the lower teeth and gums. The mouthpiece also envelope the nostrils so that when in place all air must pass through the mouthpiece. The mouthpiece is made of plastic, such as, urethane.

Carrico, U.S. Pat. No. 4,719,911, discloses a cup shaped filter mask which fits against the face of a person over the nose and mouth. It is held in place by a mouthpiece between the upper lip and the upper teeth and gums of the wearer and passes through the mask and is sealed thereto.

In general the Patents uncovered teach oval or similar shaped masks for nose guards and mouthpieces. It also teaches use of plastic material, liners and detachable, changeable filters. It also teaches the use of velcro strips for attaching various materials.

Specifically U.S. Pat. No. 3,695,265 issued to Brevik, teaches a nose and mouth mask which is held in place by adhesives and provides a positive sealing force about the nose and mouth. Fisher, U.S. Pat. No. 4,895,143, discloses a mouth and nose mask which is held in the mouth and secured therein by a pliable plastic which does not require a hard bite by the user to hold it in place. The Carrico Patent discloses a filter which is held in place by a mouthpiece, although, it does not illustrate the physical characteristic of present invention.

None of the Patents illustrate the exact design of present invention utilizing a replaceable filter and a sanitary cover for the mouthpiece.

SUMMARY OF THE INVENTION

According to the present invention there is provided an environmental mask or shield with a nose cover and mouthpiece integrated into one device or article. The nose cover is a thin wall shield with the lower portion open to the nasal passage of the wearer. The nose cover includes a velcro attachment for holding a nose filter in place. The mouthpiece supports the nose cover and is held in the mouth of the wearer. The mouthpiece may be hollow and may include a filter. The mouthpiece is adapted to receive a double wall sanitary cover which fits over the mouthpiece. The sanitary cover is disposable and may be replaced for multiple use by different individuals. The nose filter is made of cotton or the like to provide comfort from the plastic being in contact with the nose although it is not essential to cover the entire interior of the nose cover with the filter material. The nose cover may be sized to allow the user to wear eyeglasses comfortably while using the mask.

According to another aspect, the mouthpiece of the environmental mask may be hollow, but closed at either end to avoid air passage through the mouth. Also, the hollow mouthpiece may be used and fitted with a sanitary cap instead of the sanitary cover to prevent air passage through the mouth.

In another aspect, the environmental mask can be used by commercial beauty salons by virtue of the fact that the nose filter and sanitary cover for the mouthpiece may be readily replaced with fresh filters and sanitary covers thereby permitting the basic environmental mask to be used repeatedly with various customers under sanitary conditions. This environmental mask would provide the client or customer with free use of their hands for reading newspapers or magazines while their hair is being set with hairspray.

DETAILED DESCRIPTION OF PREFERRED EMBODIMENT OF THE INVENTION

Figure 1:
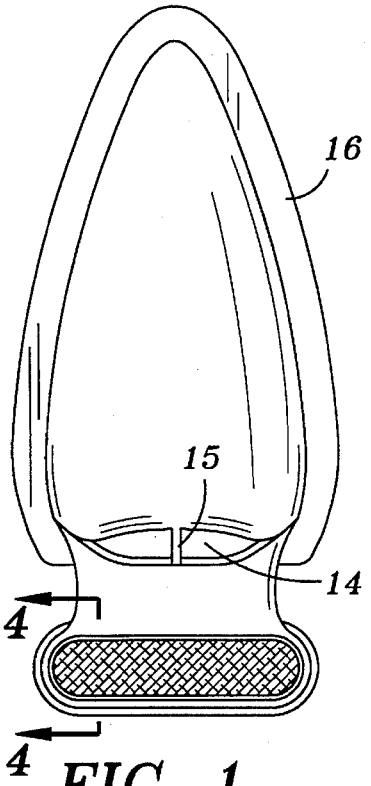
FIG. 1 is a view of the environmental mask looking at the interior of the nose cover.
Figure 2:
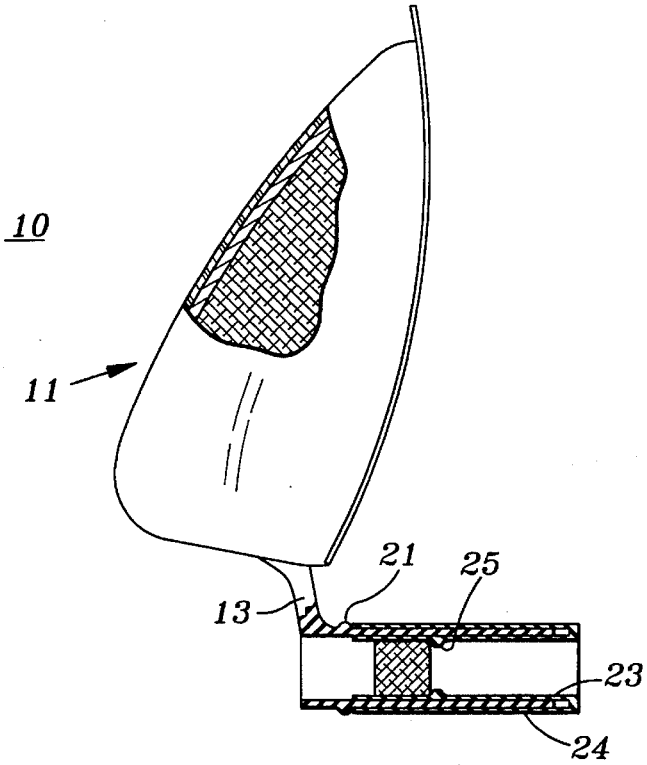
FIG. 2 a view partial in cross-section taken along section 2—2 in FIG. 1 and partly broken away to illustrate the nose cover and nose filter,and the mouthpiece and filter.
Figure 3:
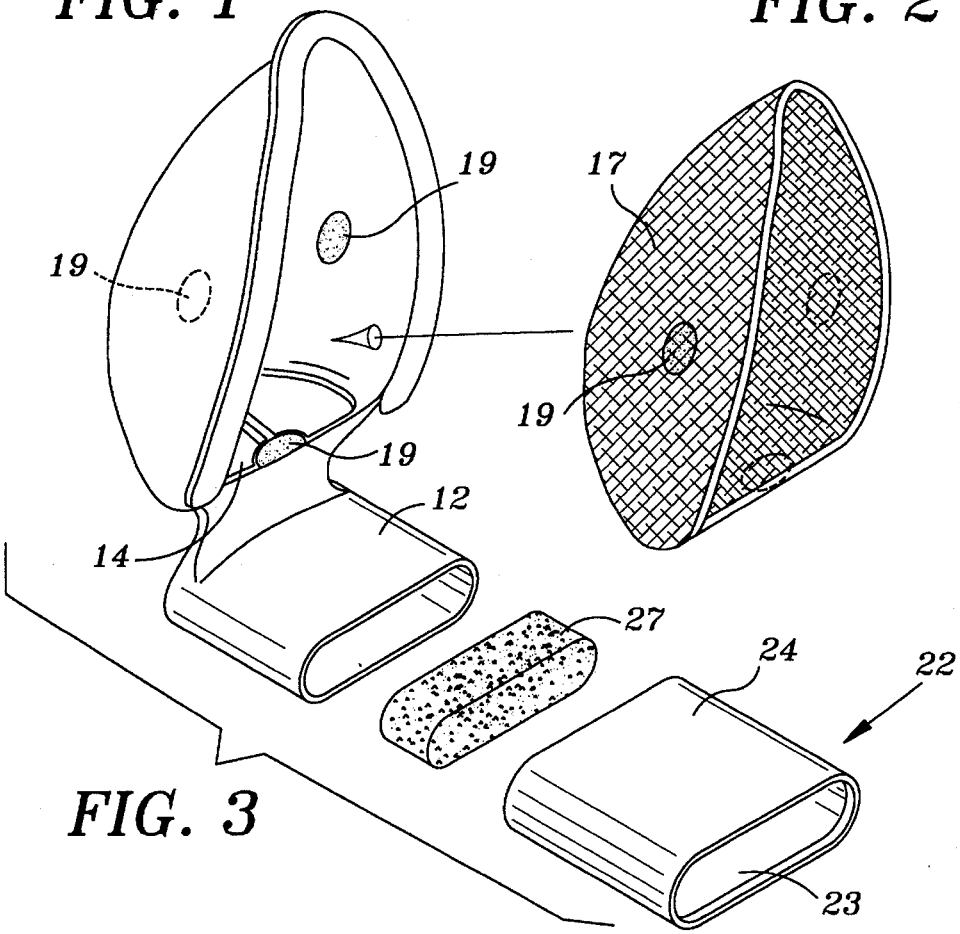
FIG. 3 is an exploded perspective view of the components of the environmental mask.

With reference to FIGS. 1, 2 and 3, the preferred embodiment of the environmental mask generally referred to as 10 is an integrated nose cover 11 and mouthpiece 12. The nose cover 11 is supported and joined to the mouthpiece 12 by support bracket 13. Nose filter 17 is secured within nose cover 11 by velcro fasteners 19 which, as illustrated, are placed in three locations, beside each nostril and at the edge of the nostril airway 14. The nose cover 11 also includes a facing 16 to conveniently seat about the nose on the face of the wearer. The nose filter 17 may be replaced after each use by the same wearer or must be replaced by each use with a new patron to provide sanitary use of the environmental mask 10. The brace 15 provides the maximum nasal airway 14 while retaining the nose cover relatively stable.

The mouthpiece 12 may have an external rib 21 for the purpose of preventing the sanitary cover 22 from extending to far forward and engaging the support bracket 13. The sanitary cover 22 has an outer wall 24 and an inner wall 23. The inner wall 23 is provided with an internal rib 25 which permits the mouth filter 27 to be seated within the sanitary cover 22, but prevented from movement towards the mouth by the internal rib 25. Mouth filter 27 is readily replaced after each use of the environmental mask 10.

The environmental mask 10 is made of any suitable lightweight plastic material which may be molded with it's nose cover 11, support bracket 13 and mouthpiece 12, integrated and molded in one piece.

In utilizing the environmental mask 10, a nose filter 17 with velcro fasteners 19 is attached within the nose cover 11 to the corresponding velcro fasteners. A mouth filter 27 is positioned in the sanitary cover 22 seated against internal rib 25. The sanitary cover 22 is then positioned over mouthpiece 12 and seated against external rib 21. The individual would then open their mouth and comfortably place the environmental mask over the nose with the mouthpiece in the mouth of the user and then held in place by the mouth. Once properly seated by the user the environmental mask 10 permits free use of both hands to apply hairspray to the hair without the problem of inhaling particulate matter carried by the hairspray.

FIGS. 4, 5, 6, and 7, illustrate other embodiments with various arrangements for the mouthpiece.

Figure 4:
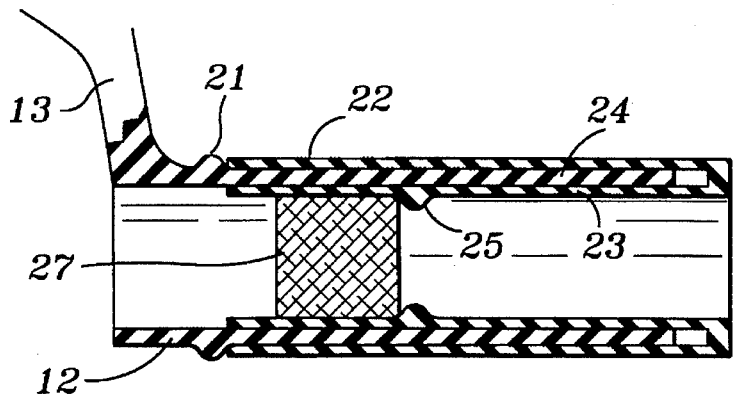
FIG. 4 is an enlarged cross-sectional view of the mouthpiece and sanitary cover illustrated in FIG. 2.

In FIG. 4, mouthpiece 12 is open at both ends and has an external rib 21. Sanitary cover 22 is seated over the end opposite support bracket 13 of mouthpiece 12 with the end outer wall 24 engaging external rib 21. Sanitary cover 22 has an internal rib 25 on inner wall 23. Filter 27 is positioned inside inner wall 23 against internal rib 25. It will be understood that filter 27 could be mounted in the mouthpiece 12 instead of in the sanitary cover 22.

Figure 5:
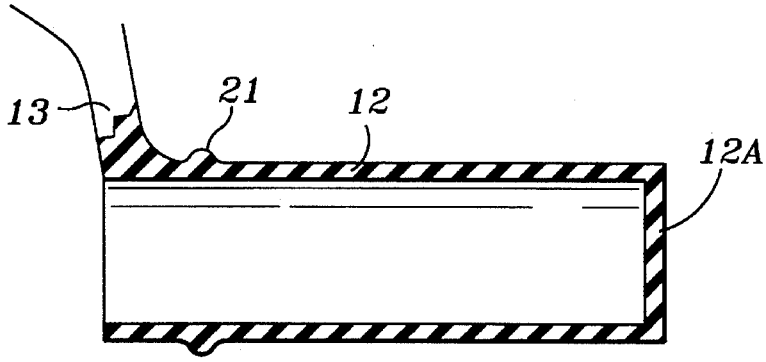
FIG. 5 is an enlarged cross-sectional view illustrating the mouthpiece in FIG. 3 being closed at the end distal from the support bracket.

In FIG. 5, the mouthpiece 12 has a closed end 12a distal from the support bracket 13, and thus, eliminates the necessity of any filter and the user would breathe through their nose only.

Figure 6:
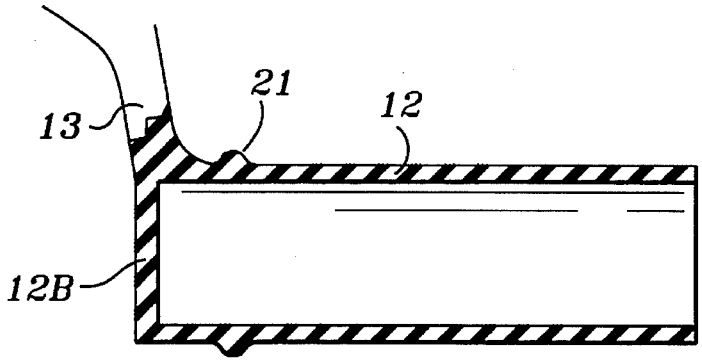
FIG. 6 is an enlarged cross-sectional view illustrating the mouthpiece in FIG. 3 being closed at the end adjacent the support bracket.

In FIG. 6, the mouthpiece 12 has a closed end **12*b* adjacent support bracket 13**, and thus, eliminates the necessity of any filter and the user would breathe through their nose only.

Figure 7:
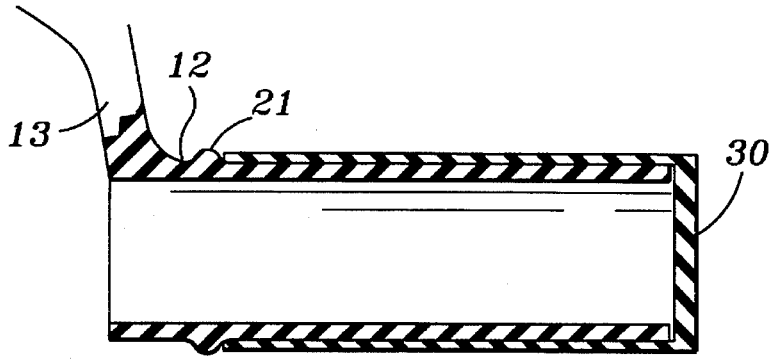
FIG. 7 is an enlarged cross-sectional view of the mouthpiece in FIG. 3 illustrating the mouthpiece closed by a cap.

In FIG. 7, the mouthpiece 12 is open at both ends but has a sanitary cap 30 which fits over the end distal from support bracket 13 and engages external rib 21.

It will be appreciated that sanitary cover 22 and sanitary cap 30 may be shortened, if desired, however, it would not present a smooth outer surface for engaging the mouth of the user.

It will be appreciated, for good oral hygiene practices, that a sanitary shield would be used in connection with the mouthpiece, such as, sanitary cover 22 or sanitary cap 30 or a similar item to be placed over the mouthpiece to maintain the mouthpiece sanitary.

What is claimed is:

1. An environmental mask including a nose cover and mouthpiece comprising:

an intergral nose cover, support bracket and hollow mouthpiece;

an airway formed in the nose cover to permit free passage of air through the airway into a nasal passage of an individual wearer;

a nose filter retained within the nose cover;

a sanitary cover removably attached to the hollow mouthpiece to avoid contact between a user's mouth and the mouthpiece; and a mouth filter for preventing particulate matter from entering a wearer's mouth.

2. The environmental mask of claim 1 wherein the mouth filter is retained within the mouthpiece.

3. The environmental mask of claim 1 wherein the mouth filter is positioned in the sanitary cover.

4. An environmental mask for filtering air entering airways of a user comprising:

a unitary nose cover and mouthpiece which is held in place over a user's nose by retention of the mouthpiece in a user's mouth;

an airway formed in the nose cover to permit free passage of air through the airway into an individual wearer's nasal passage;

a nose filter retained within the nose cover; and a sanitary shield removably attached to the mouthpiece to avoid contact between the a user's mouth and the mouthpiece.

5. The environmental mask of claim 4 wherein the mouthpiece is hollow and is closed at one end.

6. The environmental mask of claim 4 wherein the mouthpiece is hollow and a mouth filter is retained therein.

7. The environmental mask of claim 4 wherein the mouthpiece is hollow and the sanitary shield is a cap to prevent passage of air through the mouthpiece.

8. The environmental mask of claim 4 wherein the mouthpiece is hollow and the sanitary shield is a sanitary cover of double wall construction and retains a mouth filter.

* * * * *